United States Patent [19]

DiMatteo et al.

[11] 4,085,471

[45] Apr. 25, 1978

[54] INVALID BED ARRANGEMENT

[75] Inventors: Paul L. DiMatteo, Huntington; Henry V. Diaferia, Brentwood, both of N.Y.

[73] Assignee: Dynell Electronics Corporation, Melville, N.Y.

[21] Appl. No.: 806,777

[22] Filed: Jun. 15, 1977

Related U.S. Application Data

[60] Division of Ser. No. 685,415, May 11, 1976, which is a continuation-in-part of Ser. No. 544,710, Jan. 28, 1975.

[51] Int. Cl.[2] ..... A61G 7/08; A61G 7/02

[52] U.S. Cl. ..... 5/90; 4/185 L; 5/81 R

[58] Field of Search ..... 5/81–86, 5/90, 91; 4/110, 113, 177, 185 L, 185 R; 214/332, 333, 518

[56] References Cited

U.S. PATENT DOCUMENTS

| | | | |
|---|---|---|---|
| 3,503,083 | 3/1970 | Barnett | 4/177 |
| 3,815,163 | 6/1974 | Sullivan | 4/185 L |
| 3,925,833 | 12/1975 | Hunter | 4/185 L |
| 3,997,926 | 12/1976 | England | 5/81 R |
| 4,016,005 | 4/1977 | DiMatteo | 134/30 |
| 4,023,218 | 5/1977 | DiMatteo | 5/81 R |
| 4,031,576 | 6/1977 | Epstein | 4/185 L |

*Primary Examiner*—Casmir A. Nunberg
*Attorney, Agent, or Firm*—Max Fogiel

[57] ABSTRACT

An arrangement which allows patients confined to their beds, to use a toilet without leaving their beds or to be placed in a wheel chair. A sectionalized mattress is positioned in sequential steps so as to place the patient directly over a toilet or in a wheel chair without discomfort to the patient. The mattress, together with the patient, is positioned in a manner which allows the patient to use the toilet while sitting in an upright customary manner or in an inclined manner. The section of the mattress over the toilet is removed while the patient's weight is not directed thereon. Hygienic cleansing procedures are provided in conjunction with the toilet, and the patient is returned to a reclined position after repositioning the mattress and replacement of the section of the mattress that was removed to enable the patient to use the toilet. Replacement of that secton of the mattress is carried out also while the patient's weight is not directed thereon. The mattress is positioned through a similar sequence of steps to place the patient directly into a wheel chair.

12 Claims, 22 Drawing Figures

FIG. 6
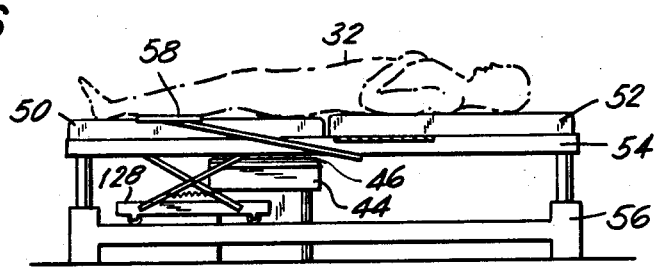
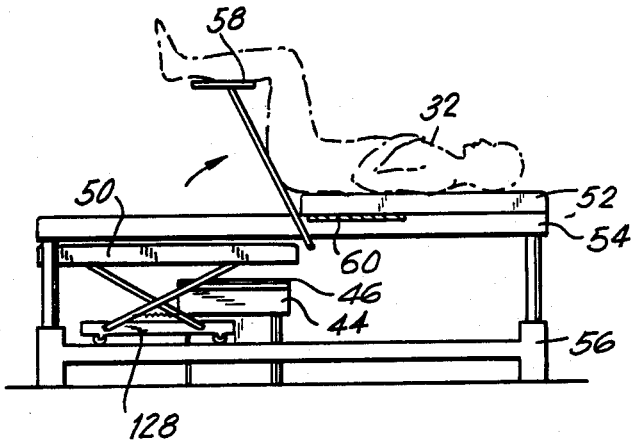
FIG. 7
FIG. 8
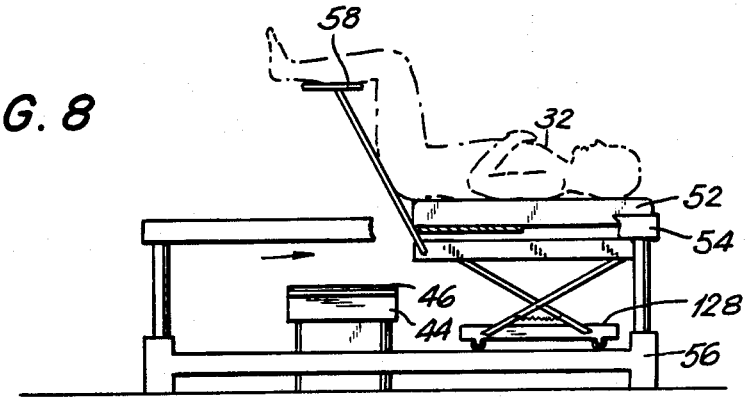

INVALID BED ARRANGEMENT

BACKGROUND OF THE INVENTION

This is a division of application Ser. No. 685,415 filed May 11, 1976, which was a continuation-in-part of the parent application Ser. No. 544,710 filed Jan. 28, 1975.

Toilet apparatus intended for persons generally confined to their bed, is already known in the art. However, the conventional apparatus which is available, heretofore, is not comfortable to the patient, does not allow the patient to use the toilet in the normal customary manner, and often requires that the patients leave their beds.

Conventional devices often used for patients are bedpans. These irritate the skin of the patient, and do not allow the patient to sit upright in the desired normal customary manner. Other conventional devices known in the art require that the patients be displaced relative to their beds, or leave their beds, in order to enable them to use the toilet in a seated normal upright position. Still other apparatus available in the art require that hospital aids, for example, exert considerable effort and carry out laborious procedures to apply the apparatus to the patient for use. This is often particularly uncomfortable to the patient, and requires that the aides possess substantial physical strength to carry and position the patient. The apparatus, furthermore, does not include provisions for hygienic cleansing and leaves the patient often in discomfort.

In addition to the disadvantages inherent in the conventional apparatus or hospital bed, these do not include provisions for transferring a patient from the bed to a wheel chair without requiring attendants to remove the patient from the bed and carry the patient into the wheel chair when the patient does not have, for example, sufficient muscle control or strength.

Accordingly, it is an object of the present invention to provide an arrangement which permits bedridden patients to use a toilet in a seated normally upright position, without leaving their beds.

It is another object of the present invention to provide a toilet arrangement which permits patients to use a toilet without leaving their beds, and without requiring that the patients exert substantial effort in becoming positioned over the toilet.

A further object of the present invention is to provide a toilet arrangement of the foregoing character which applies hygienic cleansing to a patient after use of the toilet.

It is also an object of the present invention to provide an arrangement in conjunction with the toilet apparatus, which enables a patient to be placed directly into a wheelchair from the bed, without requiring that the patient be carried into the wheel chair or that the patient take physical steps to be seated into the wheel chair.

It is a particular object of the present invention to provide the foregoing arrangement for placing a patient over a toilet or into a wheel chair, in which the patient cannot exert any movements due to, for example, lack of muscle control or physical strength.

A still further object of the present invention is to provide an arrangement as described, which is simple in design, requires no special skill to use or operate, and may be maintained economically in service.

SUMMARY OF THE INVENTION

The objects of the present invention are achieved by providing an arrangement in which the patient's mattress is subdivided into essentially two sections, a head section and a foot section. To place the patient over a toilet or into a wheel chair, the head section is raised, and the foot section is moved along the length of the bed and underneath the head section. The movement of the foot section uncovers in this manner, a toilet bowl beneath the upper bed frame, and also allows a wheel chair to be positioned over the toilet bowl. The calves of the patient are raised by a bolster arrangement which supports the legs of the patient raised above the bed, with the knees bent.

After transfer of the foot section of the mattress beneath the head section, the latter is lowered to an extent whereby the posterior of the patient is placed in direct contact with a conventional toilet seat. The patient can use the toilet by remaining in an inclined position, or the head section may be rotated to enable the patient to be seated on the toilet in the conventional manner. In the latter position, the patient is seated upright or erect with feet directed downward in the normal customary manner of using a toilet.

The arrangement in accordance with the present invention, also permits rolling a wheel chair directly beneath the patient and over the toilet bowl, and to manipulate the patient so as to become seated comfortably in the wheel chair, without requiring that the patient be lifted or slid off the bed and moved over to a wheel chair.

After the patient has completed use of the toilet, or is to be returned to the bed from a wheel chair, the mattress sections are positioned in the reverse manner, and the patient becomes located on the bed in an inclined position without requiring attendants to lift or otherwise move the patient.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 6–10 are schematic diagrams and show the relative positions of essential elements in carrying out the sequence of operations in accordance with another embodiment of the present invention;

DESCRIPTION OF THE PREFERRED EMBODIMENTS

Figure 1:
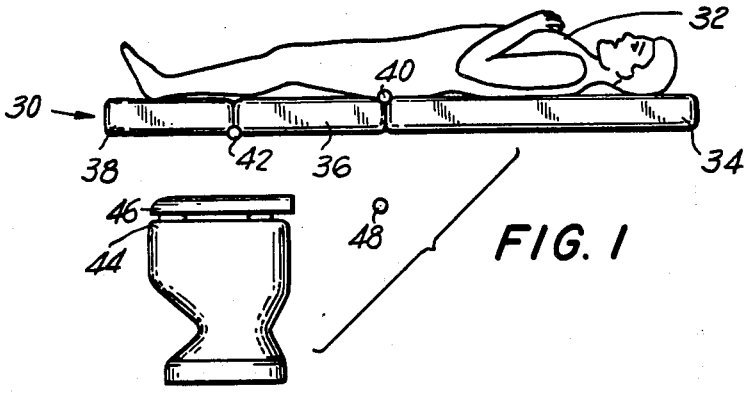
FIGS. 1 to 5 are schematic diagrams and show relative positions of the essential elements in carrying out the sequence of operations in accordance with one embodiment of the present invention.

Referring to the drawing, FIGS. 1 to 5 illustrate schematically the steps of moving a patient from a reclined position to a position in which the patient is seated over the toilet. In accordance with this arrangement of the present invention, a mattress 30 carrying a patient 32 is subdivided into essentially three sections comprised of a head section 34, central section 36, and foot section 38. The three sections are pivotable about pivots 40 and 42.

In the normal or usual position of the mattress 30, sections 34, 36 and 38 are coplanar, as shown in FIG. 1, and the patient may lie thereon in a reclined manner.

Figure 2:
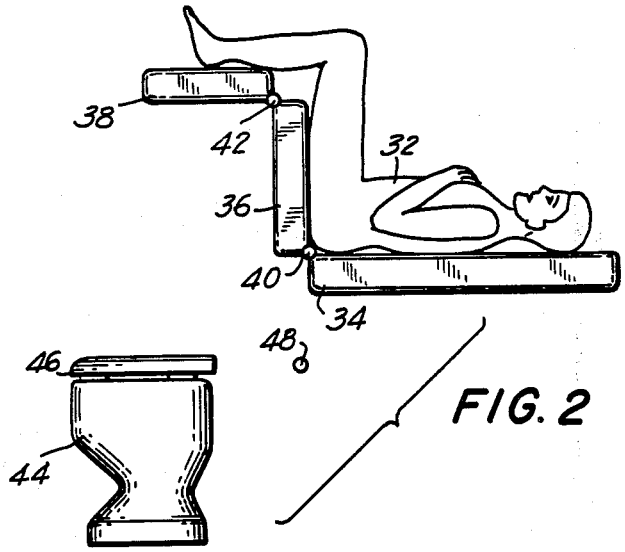

To carry out the procedure for placing the patient over a toilet 44 located beneath the mattress 30, the central section 36 is rotated relative to the head section 34 about pivot 40, into the position shown in FIG. 2. When section 36 is rotated substantially 90° about pivot 40 with respect to section 34, section 38 becomes rotated substantially 90° with respect to section 36, so that the patient lies in the position shown in FIG. 2 with feet supported upwards by the section 38, and head and back lying downward on section 34.

Figure 3:
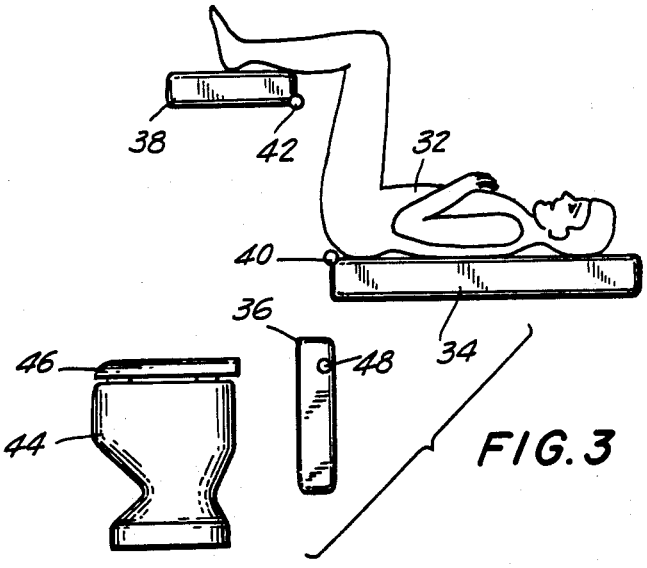

After the configuration of FIG. 2 has been attained, the central section of the mattress 36 is lowered to a position shown in FIG. 3, for the purpose of uncovering the area of the patient's posterior.

Figure 4:
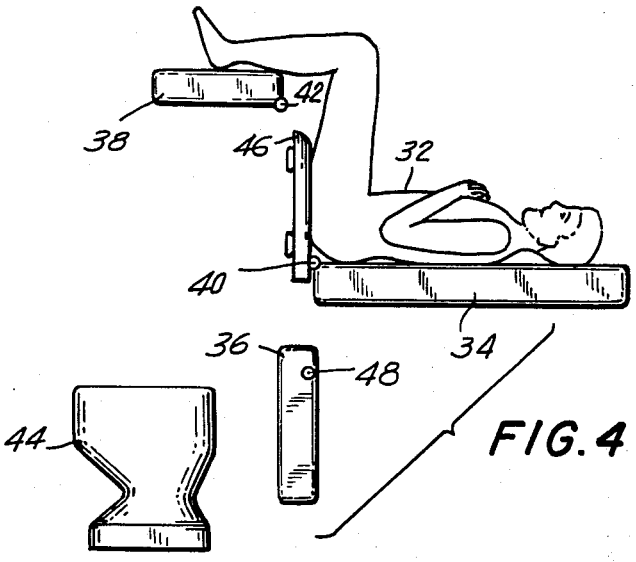

A toilet seat 46 resting normally on the toilet 44 is then rotated about a pivot 48 to bring the toilet seat 46 into contact with the patient's posterior as shown in FIG. 4. The linkage connecting the toilet seat 46 to the pivot 48 has been omitted from the schematic illustrations of FIGS. 1 to 5 for the purpose of clarity. The details of this linkage will be described subsequently.

Figure 5:
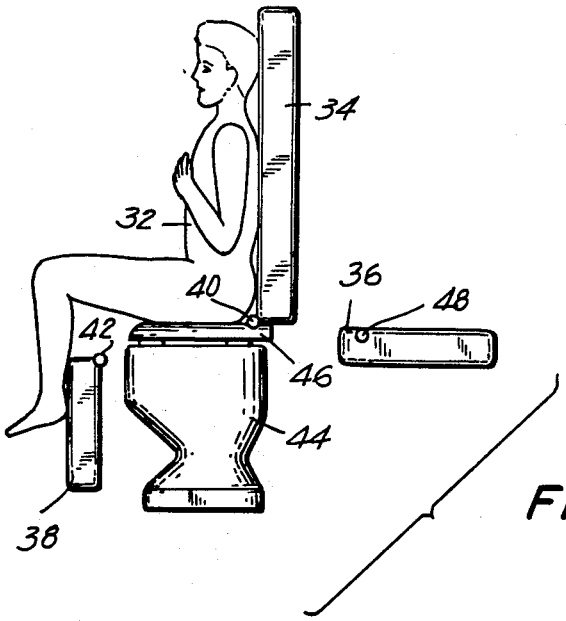

With the patient lying comfortably in the position shown in FIG. 4, the entire assembly of mattress sections 34, 36, 38, together with toilet seat 46, are rotated about the pivot 48 until the toilet seat 46 comes into contact with the top rim of the toilet 44, as shown in FIG. 5. In this position of FIG. 5, the patient is seated directly on the toilet in an upright and comfortable manner.

After the patient has terminated the use of the toilet, hygienic cleansing apparatus which may be installed directly within the toilet, may be actuated. Thereafter, the patient may be returned to a reclined position by passing through the sequence of FIGS. 4, 3, 2 and 1 in this specific reverse order.

It is an essential feature of the present invention to raise the legs of the patient as shown in FIGS. 2–4, also for the purpose of placing the patient into a wheel chair. When the patient is positioned as in FIG. 3, for example, it is possible to roll into place a wheel chair beneath the patient and over the toilet bowl, and thereafter manipulate the patient so as to bring the latter into an upright seated position directly on the wheel chair. Accordingly, the present invention does not only serve the function of seating the patient comfortably over a toilet bowl, but also seating a patient with ease and comfort in a wheel chair.

In a further embodiment of the present invention illustrated in FIGS. 6-10, the mattress of the patient's bed is subdivided into two sections 50 and 52. These mattress sections are supported on a main bed frame 54 which may be raised and lowered with respect to a base stationary frame 56. A bolster supporting member 58 is placed transversely across the bottom mattress section 50 and beneath the calves of the patient.

To raise the legs of the patient as shown in FIG. 7, the bolster member 58 is raised by being pivoted, for example, about a pivot 60. At the same time, the head mattress section 52 is raised to a level about the bottom mattress section 50. Raising of the mattress section 52 can also be carried out after the bolster 58 has been rotated into the raised position shown in FIG. 7.

After having attained the configuration of FIG. 7, the bottom mattress section 50 is moved to a location beneath the head section 52. During this movement of the mattress section 50, the patient remains in the position shown in FIG. 8 with the legs raised and supported by the bolster member 58.

Figure 9A:
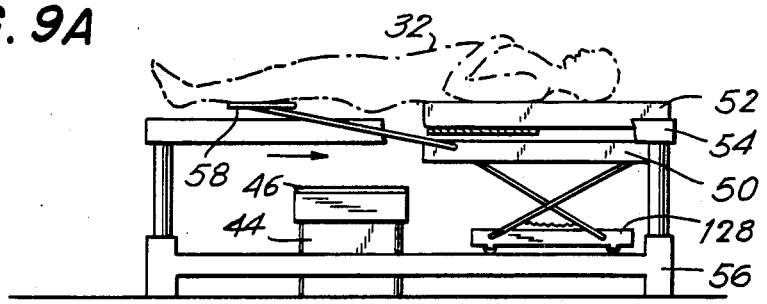
Figure 9:
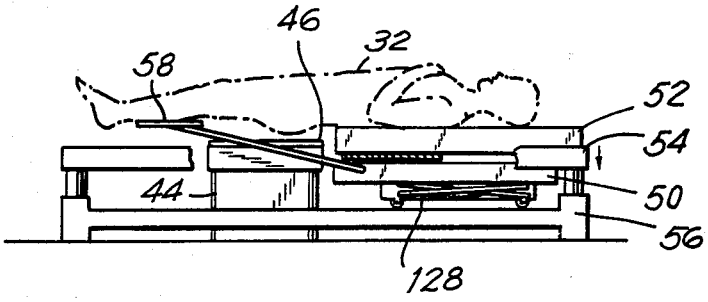

Thereafter, the supporting movable frame member 54 is lowered, together with the head section 52. In lowering the head section 52, the latter moves downward on the bottom section 50 located directly beneath section 52, until the top surface of the head section 52 is located substantially in the plane of the top surface of the toilet seat 46. The resultant positions of sections 50 and 52 are shown in FIG. 9. The bottom mattress section 50 is supported by a frame structure, to be described, which permits this mattress section to be considerably lowered beneath the head section 52.

At the time that the head section 52 is lowered to attain the configuration of FIG. 9, the legs of the patient are permitted to drop by lowering the bolster member 58. The latter is lowered, in this manner, so that the patient will assume the inclined position shown in FIG. 9, in which the posterior of the patient is positioned directly in contact with the toilet seat, as shown in FIG. 9. This inclined position shown in FIG. 9, permits patients to remain inclined, if they are not comfortable when seated in the conventional manner over the toilet. FIG. 9*a* shows the step in which the patient is allowed to remain in inclined, flat lying position, prior to arriving at FIG. 9, should this be the more comfortable position for the patient. In this inclined position of the patient, furthermore, the upper surface of the toilet seat takes the place of a conventional bedpan. However, with the arrangement of the present invention, it is not necessary to move the patient in the manner required when using a conventional bedpan, so as to bring the posterior of the patient over the bedpan. The back of the patient in the present invention, moreover, is also not bent, as it is when using a conventional bedpan. Accordingly, the configuration of FIG. 9 permits a patient after an operation, for example, to lie inclined while not experiencing the discomfort accompanying conventional bedpans.

Figure 10:
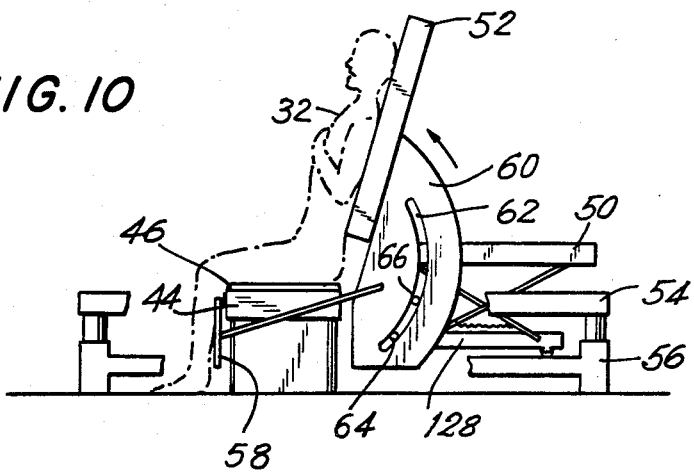

In the event that the patient is more comfortable in a seated position over the toilet, the head section 52 is moved out of the position shown in FIG. 9, and into the position shown in FIG. 10. The movement of this head section 52 is achieved by applying a rotational force to a guide member 60 attached to the head section 52 and having an arc-shaped slot 62. Stationary pins 64 and 66 are spaced within the groove 62 and confine the path of the guide member 60 and hence the movement of the head section 52. The guide member 60 shown in FIG. 10, is omitted from FIGS. 6–9 for the sake of clarity. When raising the head section 52, moreover, the bolster 58 is further lowered to permit bending of the patient's knees, as shown in FIG. 10, to enable the patient to be comfortably seated.

The provision of rotating the head section 52 into the position shown in FIG. 10, is also an essential feature when positioning the patient so as to seat the patient in a wheel chair.

Figure 11:
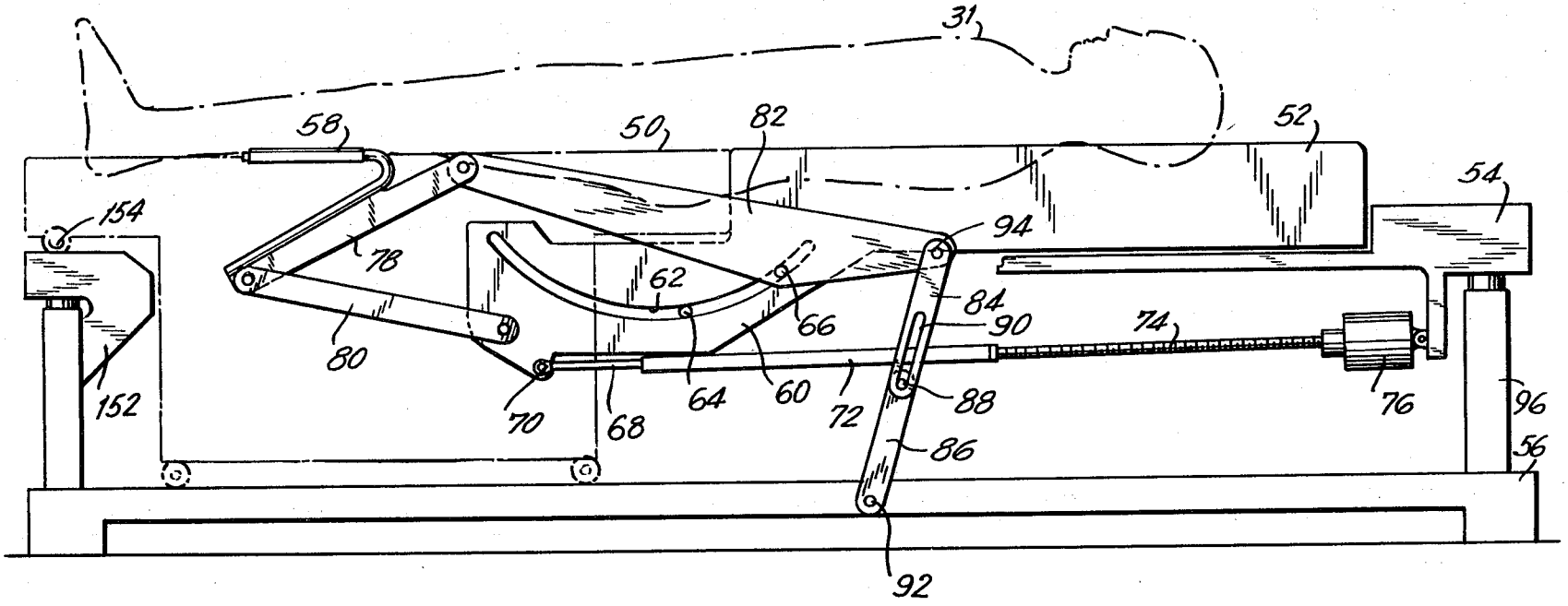
FIG. 11 is a side elevational view and shows the normal position of the arrangement of the present invention, with the patient in reclined position corresponding to FIG. 6.

To carry out the arrangement of FIGS. 6–10 in accordance with the present invention, the mechanism and linkages for positioning the head section 52 and the bolster member 58 are shown in FIG. 11. Attached to the guide section member 60, is a rod 68 at the pivot 70. The rod 68 is joined to a sleeve member 72 having an internal thread. A threaded rod 74 engages the internal thread of the sleeve member 72, and is driven rotatably by a motor 76 supported on the movable bed frame member 54.

The bolster member 58 is attached to a link 78 which is connected to the guide section 60 by means of the connecting link 80.

A lever 82 has one arm connected to the link 78, and the other arm connected to a slotted bar member 84. The lever 82 is supported on the pivot or pin 66. The slotted bar member 84 is further linked to a bar member 86 which has a pin 88 riding within the slot 90 of the bar member 84. The bar member 86 is connected to the stationary bed base frame 56, by the pivot 92. The linkages and mechanisms for positioning the head section 52 and bolster 58, shown in FIG. 11, correspond to the configuration of the patient in FIG. 6.

Figure 12:
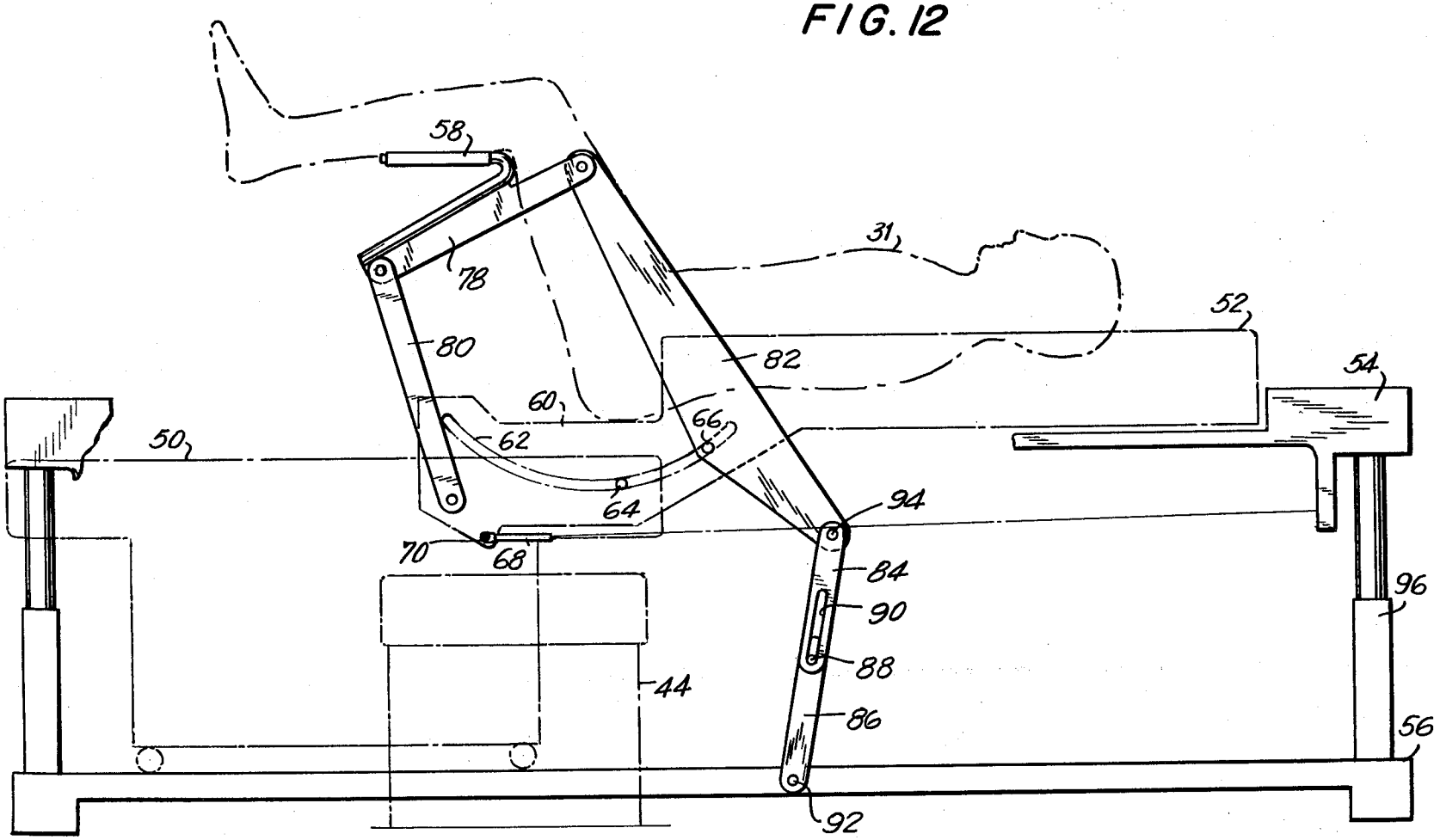
FIG. 12 is a side elevational view corresponding to the arrangement with the patient in the configuration of FIG. 7.

To raise the legs of the patient into the position shown in FIG. 7, the head section 52 is raised by raising the movable bed frame 54 above the stationary base frame 56. The raising of the bed frame 54, as shown in FIG. 12, results in raising the pivot 66. Since the arm of the lever 82 which is connected to the slotted bar 84, is constrained by the pivot 94, raising of the pivot 66 of the lever 82 results in positioning of the links 78 and 80, as shown in FIG. 12. As a result, in this position of FIG. 12, the bolster member 58 is substantially horizontal and supports the calves of the patient.

To effectively constrain the pivot 94 for the purpose of achieving the position shown in FIG. 12 after raising the head section 52, it is essential that the pin 88 abuts the lower end of the slot 90, as shown in FIG. 11, prior to raising the head section 52 by means of the movable frame 54. In this relative position of the pin 88 and slot 90, the bars 84 and 86 have the maximum overall length, whereby the distance between pivots 92 and 94 is correspondingly maximum.

Figure 13:
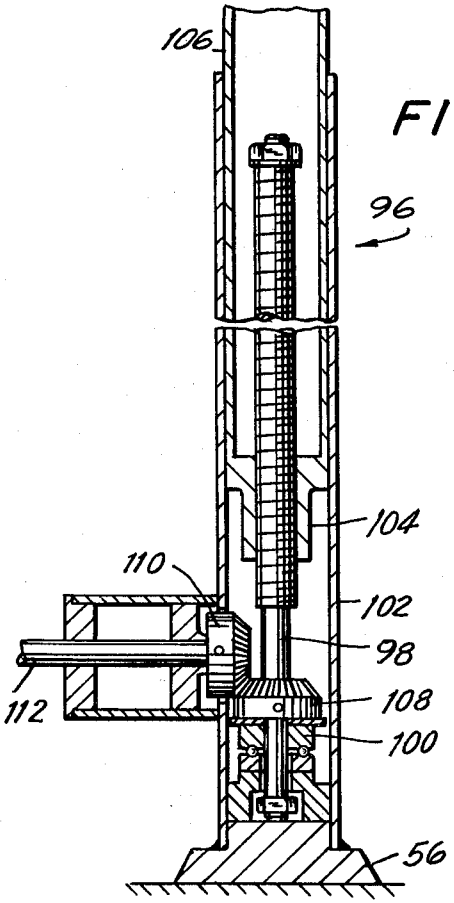
FIG. 13 is a partial sectional view and shows the construction for raising the head section of the bed.

The raising and lowering of the movable bed frame 54 is achieved by means of elevator columns 96, shown in detail in FIG. 13. In this elevator column, a threaded rod 98 is supported in a bearing 100 fixed to the stationary frame member 56 by means of a substantially cylindrical stationary sleeve 102. An internally threaded sleeve or nut 104 moves along the longitudinal axis of the rod 98 when the latter is rotated in the bearing 100. The top surface of the threaded sleeve or nut 104 supports a further tubular member 106 which surrounds the threaded rod 98. The tubular movable member 106 supports the frame 54. A bevel gear 108 is fixed to the threaded rod 98, and is in mesh with a further bevel gear 110 driven by a shift 112. When the latter is rotated in a predetermined direction, for example, the threaded rod 98 is rotated correspondingly and the sleeve or nut 104 moves upward, and thereby raises the frame 54 supported by the tubular member 106.

Figure 14:
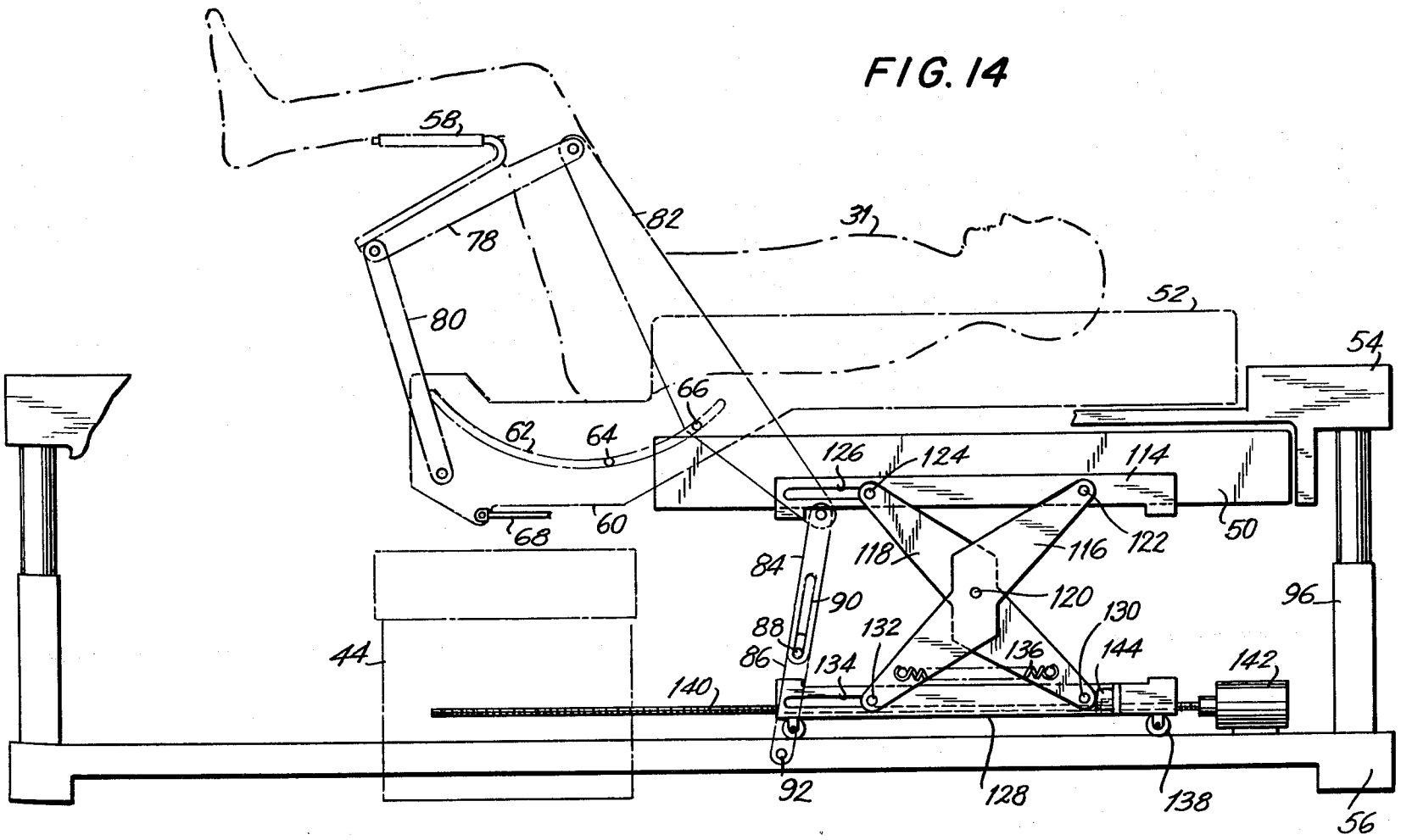
FIG. 14 is a side elevational view and shows the position of the foot section in relation to the head section corresponding to the arrangement of FIG. 8.

After the head section 52 has been raised in the manner described above, the bottom or foot section 50 is moved along the base frame 56 so as to be positioned beneath the head section 52, as shown in FIG. 14. For purposes of moving the bed section 50 from one end of the frame 56 to the other end beneath the head section 52, the bed section 50 is supported on the frame 114. Levers 116 and 118 are joined together at a pivot 120, and are linked to the supporting frame 114. Lever 116 is pivoted directly on the frame 114 at pivot 122, whereas lever 118 has a pin 124 riding in a slot 126 in the frame 114. The other ends of the levers 116 and 118 are linked to a base movable support 128. Lever 118 is connected to support 128 by means of a pivot 130, whereas lever 116 has a pin 132 riding within a slot 134 in the support 128.

The support 128 is movable along the length of the base frame 56, by means of rollers or wheels 138. Passing through an opening in the support 128, is a threaded rod 140 driven rotatably by a motor 142. A threaded nut or sleeve member 144 fixed to the support 128, engages the threaded rod 140. Consequently, when the threaded rod 140 is rotated by the motor 142, the support 128 is moved along the length of the base frame 56 on the rollers or wheels 138. In view of this construction, it is necessary to operate the motor 142 only in a predetermined direction so that the support 128 becomes moved or transferred from the foot section of the bed to a location beneath the head section 52.

A spring 136 connected to both levers 116 and 118, urges the pins 124 and 132 against the right-most ends of the slots 126 and 134. In these positions of the pins 124 and 132 relative to slots 126 and 134, respectively, the bed section 50 is held at its uppermost position, which corresponds to the position that prevails in the state when the patient lies inclined on the bed, as shown in FIGS. 6 and 11. The configuration of FIG. 14, in which the foot section 50 is positioned beneath the head section 52, corresponds to the schematic configuration of FIG. 8.

To move the patient into the position shown in FIG. 9, in which the posterior of the patient is brought directly into contact with the toilet seat, the movable set frame 54 is lowered by means of the elevator columns 96. If a conventional toilet bowl 44 is used, it is necessary to lower the patient beneath the level corresponding to FIGS. 6 and 11, at which the patient lies normally inclined. As a result, it is also necessary to lower the foot section 50 beneath the level occupied in the configuration of FIG. 14. Such lowering of the foot section 50, as may be required, is made possible by the construction of the levers 116 and 118, when taken in combination with the respective pivots and joints. Thus, as the elevator columns 96 lower the bed frame 54, the foot section 50 becomes depressed to the extent that the pins 124 and 132 move toward the left-most ends of the respective slots 126 and 134. Accordingly, the slot and pin combinations 124, 126 and 132, 134 allow the pivot 122 and pin 124 to be lowered to the position shown in FIG. 15, whereby the foot section 50 is lowered sufficiently to bring the posterior of the patient directly in contact with a conventional toilet seat.

Figure 15:
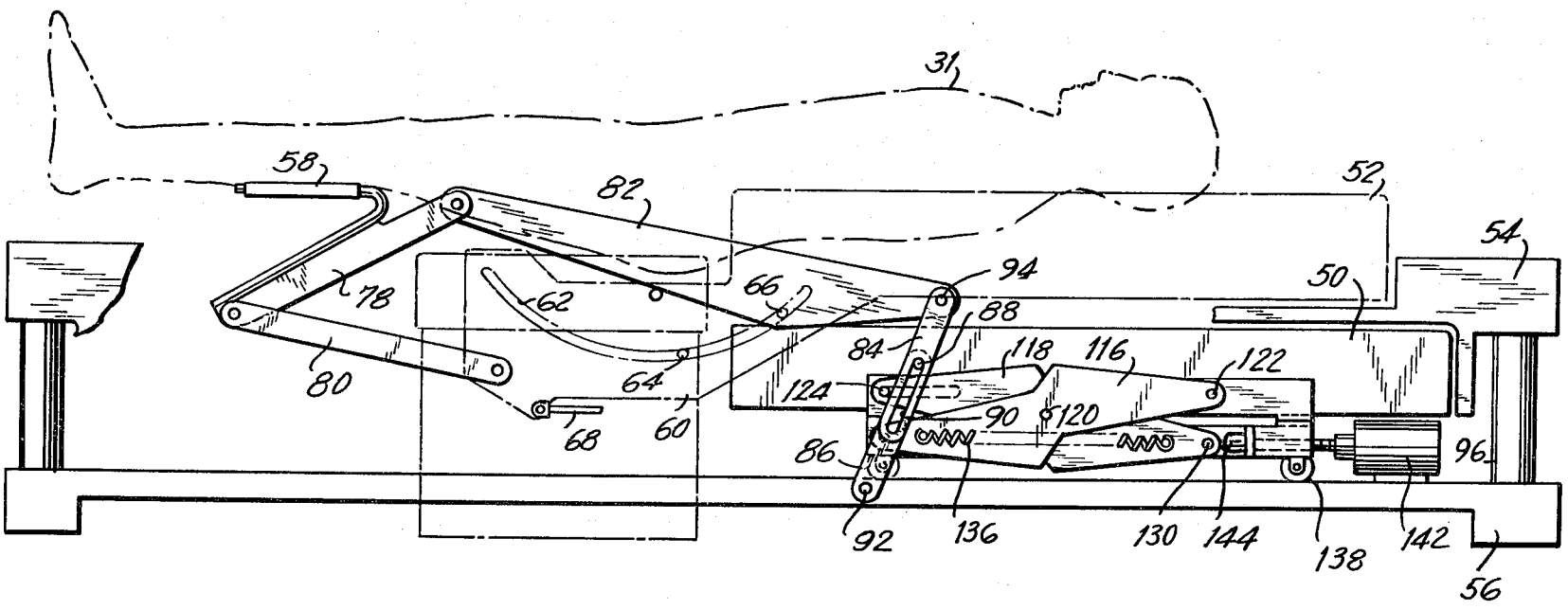
FIG. 15 is a side elevational view and shows the arrangement with the patient in an inclined position and in contact with a conventional toilet seat, corresponding to FIG. 9.

When moving the frame member 54 downward to the position shown in FIG. 15, the pin or pivot 66 moves downwardly correspondingly because the head section 52 moves down along with the frame 54. As a result, the bar member 84 attached to the lever 82 at the pivot 94, is also moved in the downward direction, and when the head section 52 has attained its lower-most level, the pin 88 is in contact with the upper end of the slot 90. The movement of the lever 82 in the downward direction causes, thereby the links 78 and 80 to assume the positions shown in FIG. 15, in which the bolster 58 is horizontal and supports the calves of the patient when in inclined position over the toilet bowl. In this position shown in FIG. 15, the spring 136 is also tensioned and elongated to its maximum length of travel.

Figure 16:
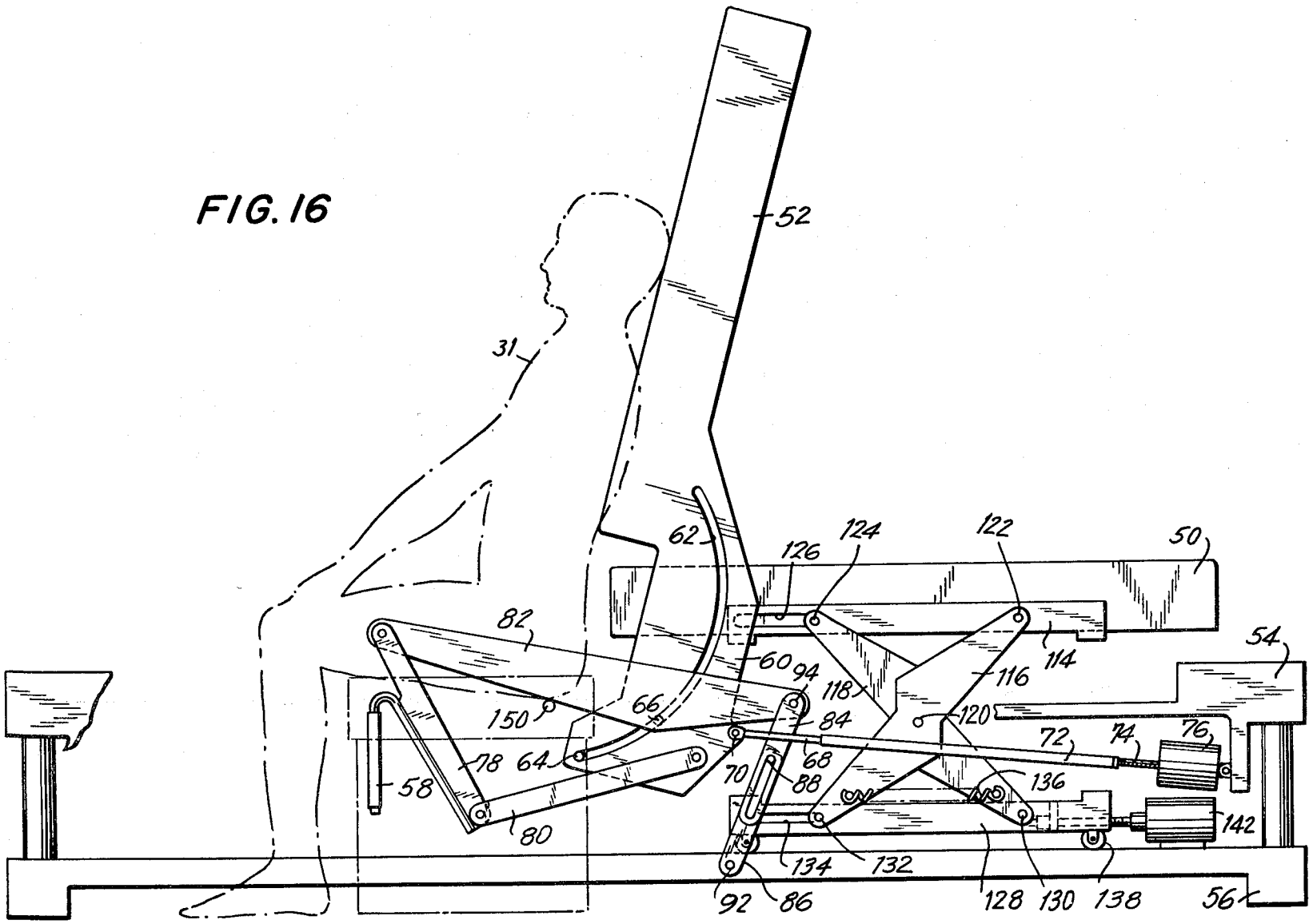
FIG. 16 is a side elevational view and shows the arrangement and position of the patient corresponding to FIG. 10.

The configuration of FIG. 15 corresponding to that shown schematically in FIG. 9, allows the patient to be in an inclined position while being in contact with the toilet seat. This avoids the use of a bed pan which is generally uncomfortable to the patient, particularly when the latter has substantial weight. If, on the other hand, the patient prefers to be positioned on the toilet seat while being seated upright in the conventional manner, the head section 52 is rotatably moved into the position shown in FIG. 16. To attain this position of section 52, the motor 76 is driven so as to rotate threaded rod 74 in the direction that will move the threaded sleeve 72 and thereby pivot 70 toward the motor. As a result of such motion of the pivot 70 on the guide section 60, the latter is forced to move along a path dictated by the arc-shaped slot 62 constrained by pins 64 and 66. The latter pins are fixed to the movable frame member 54. In view of the cooperation between the arc-shaped slot 62 and the pins or pivots 64 and 66, the guide section 60 and hence the head section 52 of the bed are positioned in accordance with the configuration shown in FIG. 16. In this configuration, furthermore, the bolster member 58 becomes drawn downward and towards the right, as shown in FIG. 16, so as to permit the legs of the patient to drop and become vertical, whereby the patient may be comfortably seated over the toilet bowl. In this position, the foot section 50 is returned to its uppermost position, since the head section 52 no longer constrains the freedom of the section 50 to move upward. As a result of the tension in spring 136 the levers 116 and 118 are rotated relative to each other whereby pins 124 and 132 ride in slots 126 and 134, respectively, to return the section 50 to the position shown in FIG. 14.

After the patient has used the toilet, the patient may be returned to an inclined position on the bed shown in FIG. 11 by reversing the operational procedures from FIGS. 11 to 16, as described above. Thus, to return the patient to the position in FIG. 11, the procedural steps are carried in the sequence of FIGS. 16, 15, 14, 13, 12 and 11.

The configuration of FIG. 12 in which the legs of the patient are raised, permits a wheel chair 146 (FIG. 17) to be rolled in place beneath the patient preparatory to seating the patient thereinto. For this purpose, the back rest 148 of the wheel chair is lowered to permit the wheel chair to be rolled close to the patient while having the legs raised as shown in FIG. 12. To seat the patient thereafter into the wheel chair 146, the head section 52 is positioned as shown in FIG. 16. Thus, when it is desired to seat the patient in the wheel chair, the latter may be rolled directly over the toilet bowl 44, and the patient may become seated into the wheel chair by movement of the head section 52 as illustrated in FIG. 16. As a result, the arrangement as shown in FIGS. 12 and 16, in accordance with the present invention, permits the patient to be seated either on a toilet or in a wheel chair with ease and comfort.

A stop 150 (FIG. 16) may be provided so as to prevent the lever 82 and connected mechanism to move further than its assigned end position.

The elevator columns 96 at the foot of the bed may also be provided with supporting elements 152 (FIG. 11) which serve to fix the horizontal position of the foot section 50 when the patient is to rest in an inclined position as shown in FIG. 11. For this purpose, rollers 154 may be provided on the section 50 to facilitate relative movement and contact with the support elements 152.

For purposes of clarity, the mechanism which moves the foot section 50 along the length of the base frame 56 and underneath the head section 52, is shown by a phantom outline in FIGS. 11 and 12. Showing this mechanism in those figures, would only serve to obscure these illustrations.

The bolster 58 may be constructed in the form of a rigid supporting member 156 (FIG. 17) which supports one end of a sheet or strip of cloth, for example. Such cloth or fabric is light in weight and comfortable to the patient when supporting the legs. As a result of being light in weight, the fabric 158 does not require substantial force to become positioned in accordance with the configurations of FIGS. 6–10.

Figure 17:
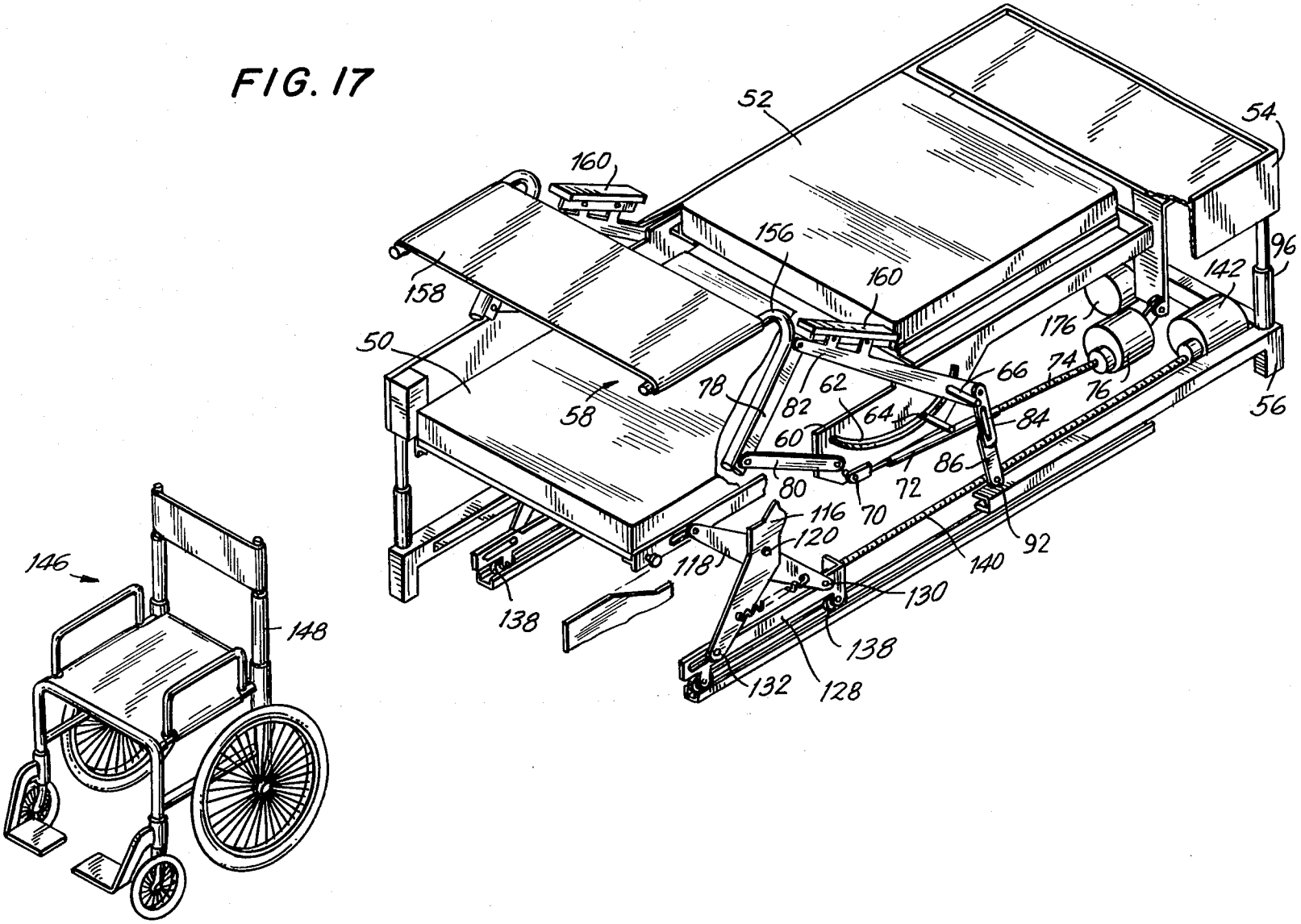
FIG. 17 is a perspective view corresponding to the configuration of FIGS. 7 and 12 in combination with a wheel chair.

For the comfort of the patient, furthermore, arm rests 160 may be attached to the levers 82, as shown in FIG. 17.

Figure 18:
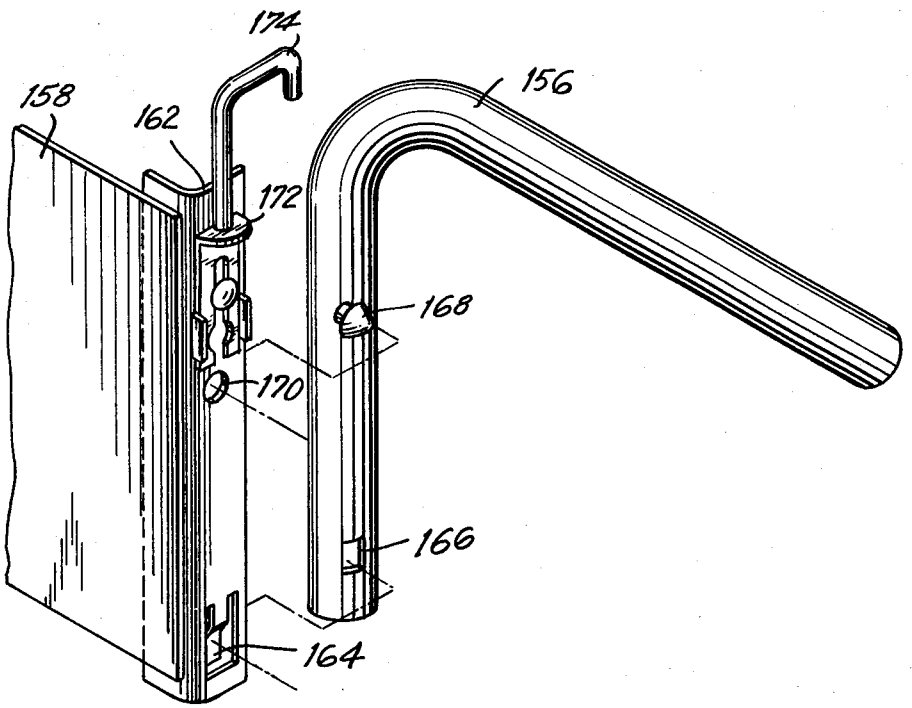
FIG. 18 is a partial perspective view and shows the supporting construction for the bolster arrangement of the present invention.

When using the wheel chair, and the patient has been positioned in accordance with the configuration of FIG. 16, it is necessary to remove the fabric or cloth 158 to permit the patient with the wheelchair to move away from the bed. For this purpose, the fabric or cloth 158 may be attached to a supporting element 162, as shown in FIG. 18. This supporting element is provided with a projecting tongue 164 which engages a cutout 166 in the member 156. The latter is provided, moreover, with a projecting cone-shaped plug 168 which passes through an opening 170 in the element 162. After the tongue 164 is positioned within the cutout 166, and the plug 168 projects through the opening 170, the locking slide 172 is moved downward around the projecting plug, and prevents the latter from passing out of the opening 170. A handle 174 facilitates moving the slide 172 in upward and downward directions for the purpose of unlocking and locking, respectively, the supporting element 162 against the member 156. Such a locking arrangement as shown in FIG. 18, may be provided at both ends of the bolster fabric 158, whereby the latter may be removed from contact with the calves of the patient, from either direction.

To carry out the operational procedures of FIGS. 11–16, it is necessary to operate motors 76 and 142 in predetermined sequence. A motor 176 is also provided for purposes of raising and lowering the movable bed frame 54. This motor 176 (FIG. 17) may be connected by conventional linkage, not shown, to the shaft 112 of the elevating column 96, shown in FIG. 13.

Figure 19:
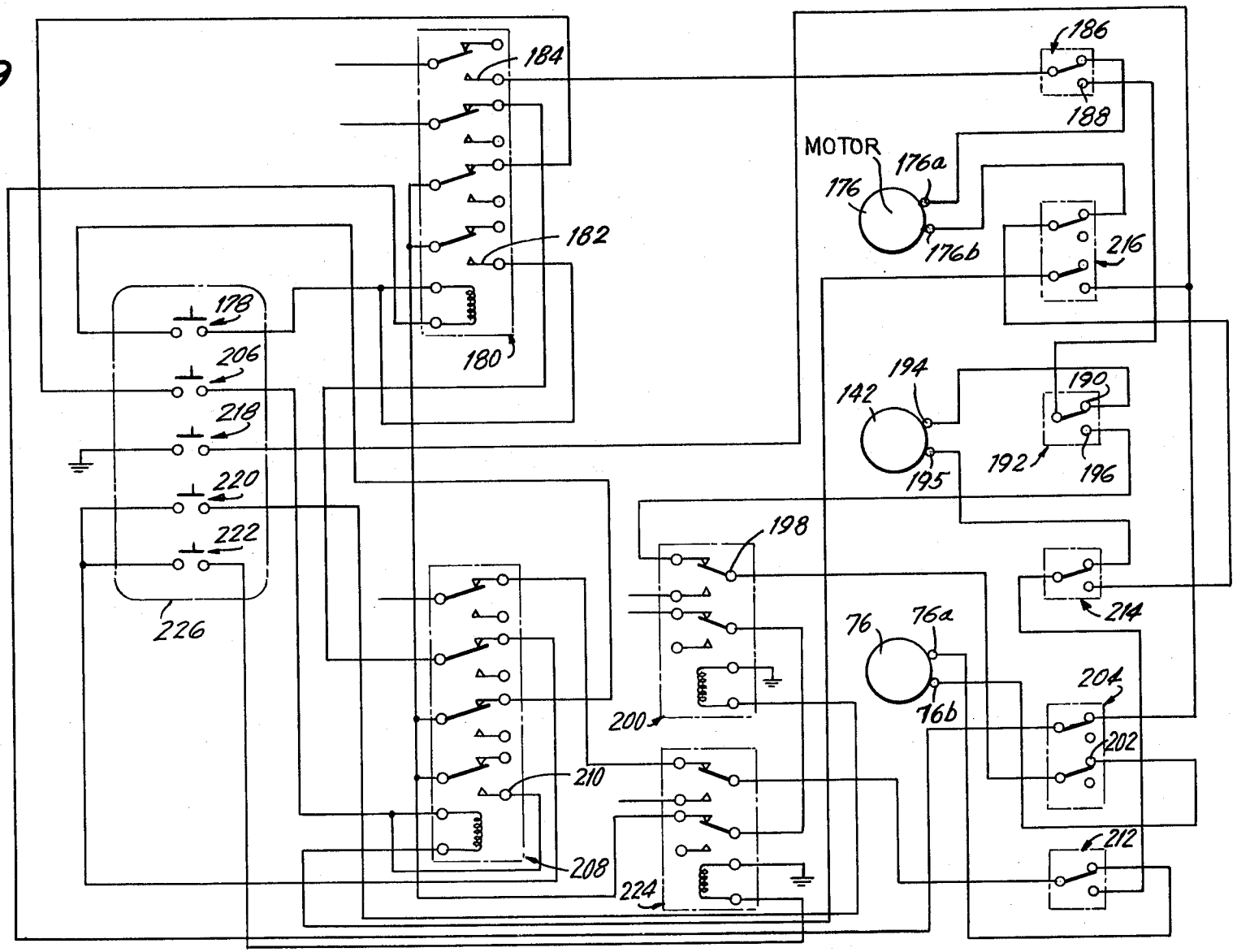
FIG. 19 is a circuit diagram for controlling the motors in carrying out the positioning of the bed sections corresponding to FIGS. 6–10.
Figure 20:
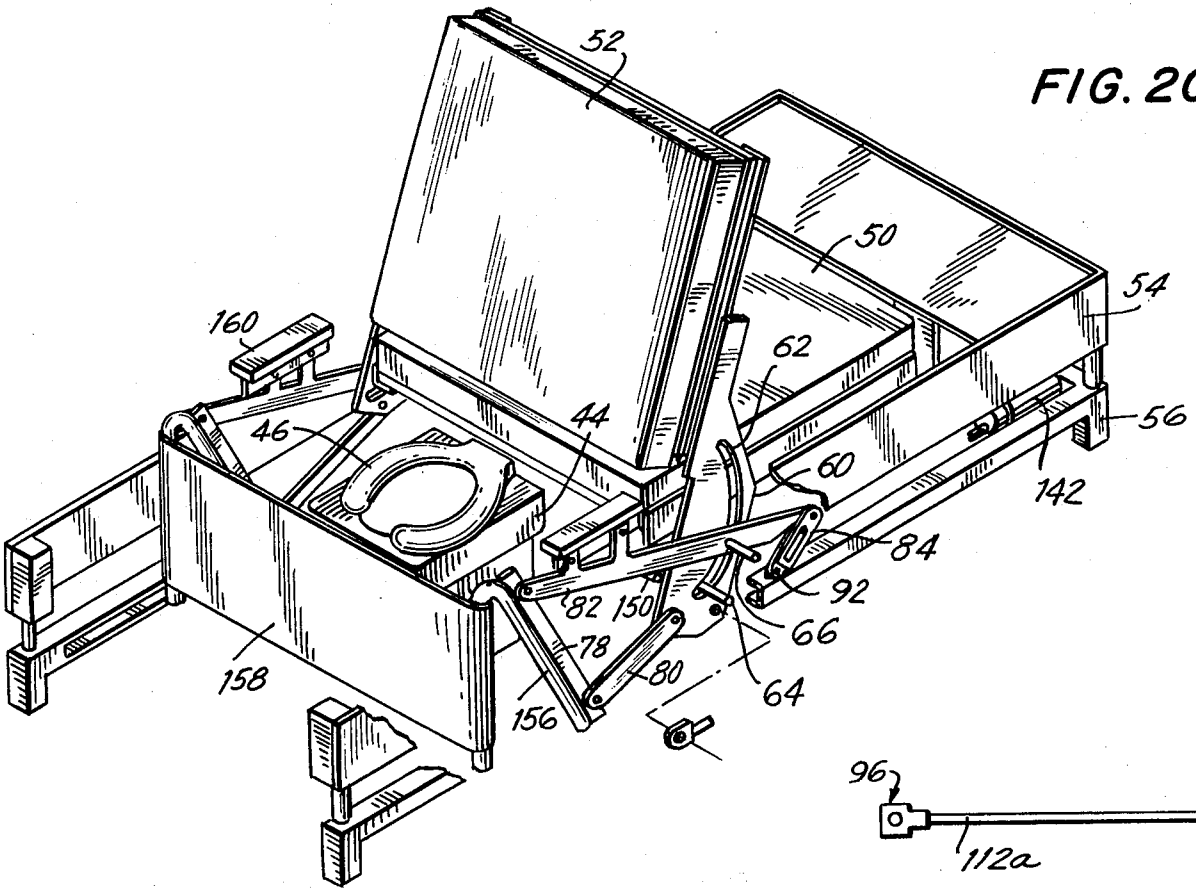
FIG. 20 is a perspective view of the arrangement corresponding to FIG. 10.

To transfer the patient from the position shown in FIG. 6 to the position of FIG. 7, the pushbutton 178, shown in the circuit diagram of FIG. 19 is actuated. This actuation causes relay 180 to become energized, and to remain in the energized state as a result of the holding contact 182 of that relay. With the actuation of relay 180, operating voltage is applied to the motor 176 through the contact 184 of relay 180, and limit switch 186. The motor 176 is operated with this circuit in a forward direction in which the movable bed frame 54 is raised. When the latter has attained its uppermost position, the limit switch 186 becomes actuated and thereby interrupts the operation of motor 176. The limit switch 186 may be mounted relative to the movable frame so that this switch 186 becomes actuated in the conventional manner when the movable frame has attained the proper uppermost level. The operation and positioning of limit switches for this purpose is well known in the art, and for this reason is not further described here.

With the operation of limit switch 186, the motor 142 becomes energized and is operated in a forward direction in which the bed section 50 is moved along the base frame 56 and beneath the head section 52. The circuit that is completed for operating motor 142 in this manner, is established by contacts 188, 190 of a further limit switch 192, and the terminal 194 of motor 142.

When the section 50 has been positioned beneath the head section 52, and has reached its end position, the limit switch 192 actuated by movement of the section 50, for example, interrupts the operation of the motor 142, and applies operating voltage to the motor 76 by way of the circuit through contacts 196, 198 of relay 200 and contact 202 of a limit switch 204. The operation of the motor 76, in this manner, causes the head member 52 to be rotated into the position shown in FIG. 10, in which the patient may be placed either over a toilet or in a wheel chair. When the end position of head section 52 has been reached, limit switch 204 actuated by the movement of section 52 in the conventional manner, for example, interrupts the power to motor 76, and thereby causes the section 52 to remain in the position shown in FIG. 10.

To return the patient and the bed to a horizontal position, pushbutton 206 is actuated. This results in the operation of relay 208 which remains in the actuated state thereafter through the circuit of contact 210. This results in applying operating voltage to the reverse terminal **76*a* of the motor 76, through the limit switch 212. When voltage is applied to the terminal 76b of the motor, the latter is operated in a forward direction as described above. After the head section 52 is returned to a horizontal position as shown in FIG. 9, limit switch 212 is actuated and applies operating voltage to the motor 142, through the limit switch 214. The latter then applies voltage to the reverse terminal 195, whereby the foot section 50 is returned to the position shown in FIG. 7. After actuation of the limit switch 212, the motor 176 is also operated in the reverse mode by applying voltage to the reverse terminal 176b by way of the circuit through limit switch 216, limit switch 214, and limit switch 212. Motor 176 is operated in the forward direction in which the frame member 54 is raised, by applying voltage to the terminal 176*a***.

The entire arrangement may be brought to a stop position by actuating the pushbutton 218 which results in the release of relays 180 and 208.

The actuation of pushbutton 220 causes relay 200 to be operated, and thereby voltage to be applied to terminal **76*b* of motor 76 through switch 204, whereby the head section 52 is moved into a raised position, as shown in FIG. 10. Similarly, actuation of pushbutton 222 will result in voltage being applied to terminal 76*a* by operating relay 224. After operation of this relay 224, voltage is applied through switch 212 for operating the motor 76 in the reverse direction whereby the head section 52 is again lowered. Accordingly, pushbuttons 220 and 222 may be used to raise and lower the head section 52**, by itself, whenever desired and for the comfort of the patient.

It is not necessary to provide the control circuit of FIG. 19 for the purpose of controlling the respective motors in sequence. Instead of the circuit of FIG. 19, for example, it is possible to use only light indicators in conjunction with the switches 178, 206, 218, 220 and 222 for the purpose of controlling the motors. In such an arrangement, the switches are depressed by the operator until the respective indicating lights provide the signal indicating when the switches are to be released. Such an arrangement, therefore, constitutes a manual operating arrangement in place of the substantially automatically controlled one shown in FIG. 19. The switches 178, 206, 218, 220 and 222 may be mounted conveniently on a control panel 226.

Figure 21:
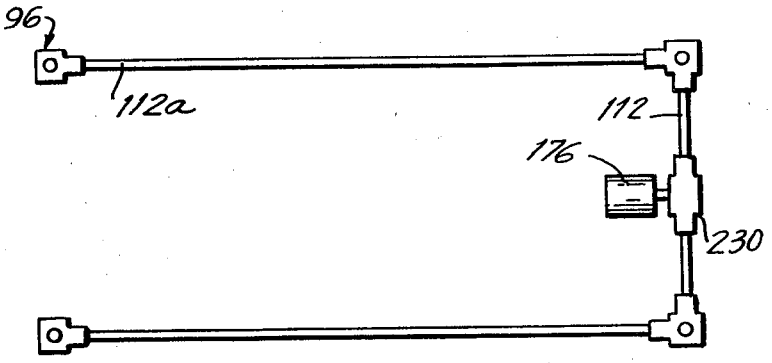
FIG. 21 is a plan view and shows schematically the transmission of motion to the bed elevating and lowering device in FIG. 13.

FIG. 21 shows the arrangement in which the elevator columns 96 at each corner of the bed are operated by the motor 176. The shaft of the motor is connected to a direction changing unit 230 having bevel gears which allow the axis of the motor shaft to be perpendicular to the axis of the shaft 112 driving the elevator column 96. Further bevel gears (not shown) in column 96 transmit the motion of shaft 112 to shaft **112*a*, for example. The direction changing unit 230** with bevel gears is commercially available and known in the art.

After a patient has used the toilet, hygienic cleansing means may be applied by the use of apparatus installed within the toilet bowl and applying a spray of water, for example, as already known in the art.

Without further analysis, the foregoing will so fully reveal the gist of the present invention that others can, by applying current knowledge, readily adapt it for various applications without omitting features that, from the standpoint of prior art, fairly constitute essential characteristics of the generic or a specific aspect of this invention, and therefore such adaptations should and are intended to be comprehended within the meaning and range of equivalence of the following claims.

We claim:

1. A method for transferring a person from a reclined position to a seated position comprising the steps of: supporting the back side of the person with the person's posterior at a first location; supporting the calves of the person; raising the calves of the person and bending the knees of the person; freeing substantially the posterior of the person, the weight of said person being directed away from said posterior during freeing thereof; returning said person to a reclined position; and lowering said person with posterior to a second location onto a seating member so that the posterior of the person is directly in contact with said seating member.

2. The method as defined in claim 1 including the step of rotating the back side of the person and lowering the feet of the person whereby the person is seated in a substantially upright manner on said seating member.

3. The method as defined in claim 1 including the step of subdividing a bed member into first and second sections; reclining said person on said bed member; raising said first bed member section while supporting the calves of said person in reclined position of said person; displacing said second bed member section beneath said first bed member section for carrying out said step of freeing said posterior while supporting the calves of said person in reclined position; and lowering said first bed member section together with said second bed member section until the posterior of said person is located at said second position on said seating member.

4. The method as defined in claim 3 including the step of supporting the calves of said person with a strip of fabric spanned transversely across said bed member, said strip of fabric being movable independent of said bed member sections.

5. The method as defined in claim 4 including the step of turning said strip of fabric so that the plane of said strip is substantially vertical when said person is seated substantially upright on said seating member, the back side of said person forming a predetermined angle with the vertical when seated in said upright position on said seating member.

6. The method as defined in claim 4 wherein said seating member comprises a wheel chair.

7. The method as defined in claim 6 including the step of moving said wheel chair beneath said person when said person is in a position with calves raised and knees bent.

8. The method as defined in claim 7 including the step of rotating said first bed member section together with the back side of said person for placing said person in seated position in said wheel chair; and turning said strip of fabric so that said strip remains in contact with the calves of said person upon being seated in said wheelchair.

9. The method as defined in claim 8 including the step of removing said strip of fabric from contact with the calves of said person to free the wheel chair for movement to a remote location.

10. The method as defined in claim 4 wherein said seating member comprises a toilet seat.

11. The method as defined in claim 7 wherein said wheel chair is moved beneath said person and over a toilet.

12. A method for moving a person in contact with a toilet seat comprising the steps of subdividing a bed member into at least first and second sections; reclining a person on said bed member, said person lying substantially flat in extended position while being reclined; raising said first bed member section while supporting the calves of said person in reclined position of said person; displacing said second bed member section beneath said first bed member section for carrying out said step of freeing said posterior while supporting the calves of said person in reclined position; and lowering said first bed member section together with said second bed member section until the posterior of said person is located on a seating member over said toilet, said seating member being located beneath the posterior of the person.

* * * * *